US009476177B2

(12) United States Patent
Blasdel et al.

(10) Patent No.: US 9,476,177 B2
(45) Date of Patent: Oct. 25, 2016

(54) ADHERENT LAYER

(71) Applicant: Stego Industries, LLC, San Clemente, CA (US)

(72) Inventors: Matthew M Blasdel, Ladera Ranch, CA (US); James M Facciuto, San Juan Capistrano, CA (US); Joseph R Marks, Ladera Ranch, CA (US); Bret N Houck, Mission Viejo, CA (US)

(73) Assignee: Stego Industries, LLC, San Clemente, CA (US)

( * ) Notice: Subject to any disclaimer, the term of this patent is extended or adjusted under 35 U.S.C. 154(b) by 50 days.

(21) Appl. No.: 14/091,021

(22) Filed: Nov. 26, 2013

(65) Prior Publication Data

US 2014/0079907 A1 Mar. 20, 2014

Related U.S. Application Data

(62) Division of application No. 12/836,523, filed on Jul. 14, 2010, now Pat. No. 8,608,883.

(60) Provisional application No. 61/225,446, filed on Jul. 14, 2009.

(51) Int. Cl.

| | |
|---|---|
| ***E02D 31/02*** | (2006.01) |
| ***B32B 5/02*** | (2006.01) |
| ***B32B 7/12*** | (2006.01) |
| ***E04C 5/07*** | (2006.01) |

(52) U.S. Cl.

CPC ..... *E02D 31/025* (2013.01); *E02D 31/02* (2013.01); *E04C 5/07* (2013.01); *Y10T 428/24331* (2015.01); *Y10T 428/24355* (2015.01); *Y10T 428/2813* (2015.01)

(58) Field of Classification Search

CPC ..... B32B 3/266; B32B 5/02; B32B 7/12; E02D 31/025; E02D 31/02; E04C 5/07

USPC ..... 428/138, 141, 343, 354

See application file for complete search history.

(56) References Cited

U.S. PATENT DOCUMENTS

| | | | |
|---|---|---|---|
| 4,699,838 | A | 10/1987 | Gilbert |
| 5,198,300 | A | 3/1993 | Matthews et al. |
| 5,257,486 | A | 11/1993 | Holmwall |
| 5,496,615 | A | 3/1996 | Bartlett et al. |
| 5,691,051 | A | 11/1997 | Matthews |
| 5,763,036 | A | 6/1998 | Terry et al. |
| 5,763,047 | A | 6/1998 | Green |
| 5,824,417 | A | 10/1998 | Smith et al. |

(Continued)

OTHER PUBLICATIONS

Barrier-Bac, Inc., BB2OT 20-mil Sealing Tape, Feb. 2008, pp. 1-2, Livingston, NJ, www .barrierbac.com.

(Continued)

*Primary Examiner* — Maria Veronica Ewald
*Assistant Examiner* — Joanna Pleszczynska
(74) *Attorney, Agent, or Firm* — Lee & Hayes, PLLC

(57) ABSTRACT

The present disclosure describes embodiments of an adherent layer that may be used to attach a geo-membrane to a concrete slab and methods that include installation of the adherent layer. The adherent layer can be used to inhibit the geo-membrane from becoming disengaged with the concrete slab and can thereby help prevent water from penetrating the geo-membrane and causing moisture damage to the structure above.

20 Claims, 7 Drawing Sheets

(56) References Cited

U.S. PATENT DOCUMENTS

| | | | | |
|---|---|---|---|---|
| 5,881,521 | A | 3/1999 | Porter et al. | |
| 6,122,887 | A | 9/2000 | Massett et al. | |
| 6,136,731 | A * | 10/2000 | Ohashi | 442/149 |
| 6,238,766 | B1 | 5/2001 | Massett et al. | |
| 6,269,595 | B1 | 8/2001 | Blubaugh et al. | |
| 6,506,466 | B1 | 1/2003 | Sieber et al. | |
| 6,524,029 | B2 | 2/2003 | Nobert et al. | |
| 6,725,616 | B1 | 4/2004 | Pease | |
| 6,898,917 | B2 | 5/2005 | Durning et al. | |
| 7,132,143 | B2 * | 11/2006 | Zanchetta et al. | 428/40.1 |
| 7,179,761 | B2 | 2/2007 | Malik et al. | |
| 7,219,479 | B2 | 5/2007 | Durning et al. | |
| 7,282,264 | B2 | 10/2007 | Ddamulira et al. | |
| 7,317,051 | B2 | 1/2008 | Georgeau et al. | |
| 7,437,855 | B2 | 10/2008 | Locke et al. | |
| 7,488,523 | B1 | 2/2009 | Muncaster et al. | |
| 7,501,169 | B2 | 3/2009 | Lavature et al. | |
| 7,686,903 | B2 | 3/2010 | Muncaster et al. | |
| 2002/0006756 | A1 | 1/2002 | Mercure et al. | |
| 2002/0172814 | A1 | 11/2002 | Nobert et al. | |
| 2003/0113534 | A1 | 6/2003 | Poisson | |
| 2004/0244315 | A1 * | 12/2004 | Rust et al. | 52/198 |
| 2006/0013989 | A1 | 1/2006 | Stull et al. | |
| 2008/0087370 | A1 | 4/2008 | Manteufel | |
| 2009/0013630 | A1 | 1/2009 | Vidal | |

OTHER PUBLICATIONS

Fortifiber Building Systems Group, Flooring and Durable Concrete Slabs, Apr. 2009, p. 1, www.fortifiber.com/concrete.html.

Barrier-Bac, IntePius XF Film, Barrier-Bac Products-Vapor Retarders, Apr. 27, 2009, pp. 1-4, Livingston, NJ, www.barrierbac.com/vaporbarriers.htm.

Final Office Action for U.S. Appl. No. 12/836,523, mailed on Dec. 3, 2012, Matthew M. Blasdel et al., "Adherent Layer", 10 pages.

Non-Final Office Action for U.S. Appl. No. 12/836,523, mailed on Aug. 3, 2012, Matthew M. Blasdel et al., "Adherent Layer", 7 pages.

W.R. Meadows, Inc., Perminator Underslab Vapor Barrier, Apr. 2009, pp. 1-5, Hampshire, IL, www.wrmeadows.com.

W.R. Meadows, Inc., Premoulded Membrane Vapor Seal with Plastic Core (PMPC), Dec. 2007, pp. 1-6, Hampshire, IL, www.wrmeadows.com.

Grace Construction Products, Underslab Vapor Barrier, approximately 2007, p. 1, www. na. graceconstruction. com/custom/water(2roof/down loads/water(2roofing handbook/PF-00 1 B. (2df.

Raven Industries, Vapor Retarders, approximately 2007, pp. 1-2, Sioux Falls, SO, www.ravenind.com.

Insulation Solutions, Inc., Viper Double Bond Seam Tape, Jul. 10, 2010, pp. 1-2, East Peoria, IL, www.insulationsolutions.com.

* cited by examiner

ADHERENT LAYER

REFERENCE TO RELATED APPLICATIONS

The present application is a divisional of and claims priority to pending U.S. Application Ser. No. 12/836,523, filed on Jul. 14, 2010, entitled "Adherent Layer", which claims priority under 35 U.S.C. §119(e) to U.S. Provisional Application No. 61/225,446 filed Jul. 14, 2009, entitled "Adherent Layer", both of which are hereby incorporated into this application in their entirety.

FIELD

The present disclosure related to materials for attaching geo-membranes to concrete slabs.

BACKGROUND

Most buildings require a flat foundation formed by pouring concrete into a form on the ground. However, after concrete hardens it is porous and therefore allows moisture, soil gases (i.e. Radon), alkaline salts, and soil sulfates to travel from the earth through the pores into either a building or other structure that has been formed on top of the concrete slab. Moisture is a broad term and includes, without limitation, water vapor, liquid water, and any and all forms and phases of water. This is a major cause of building defects and contributes to serious problems with the concrete foundation, floor coverings, and indoor air quality.

To prevent moisture and other permeating substances from migrating through the concrete slab, a geo-membrane is commonly placed on the ground before the concrete foundation is poured onto the slab. A geo-membrane generally retards or nearly completely prevents moisture and other permeating substances from rising out of the soil and permeating into the concrete slab above by preventing its migration through the barrier. This is only effective, however, if the geo-membrane below is relatively free of any open seams between sheets of the geo-membrane or substantial gaps around the perimeter for the permeating substances to leak through into the concrete slab.

Generally, to install a geo-membrane, it is laid down on the ground in sheets that must be connected in order to form one continuous barrier below the concrete slab. Seaming tape with a single side of adhesive is the usual way of sealing the sections of the geo-membrane together to provide one continuous seal below the concrete slab. This method is only effective for keeping the partitions together if the soil or void forms beneath the geo-membrane do not settle or shift unevenly.

Frequently, however, certain types of soil will sink or settle beneath the foundation after it has been poured, especially if the slab is supported by concrete piers. This causes the geo-membrane to sag beneath the foundation which, in turn, causes the seams between the section of the geo-membrane to separate. This comprises the complete permeating substance seal below the foundation and exposes the building structure to a plethora of damage from permeating substances rising from below the concrete foundation, including mold, air pollutants and other consequences of moisture and soil gas infiltration.

Lastly, after the foundation is poured over the geo-membrane and is in place a different problem arises. Generally, a concrete foundation is cut at various positions to induce cracking and separation during the shrinking of the concrete that takes place during setting. This forms gaps between various portions of the concrete which accommodates expansion and contraction through the seasons and prevents damage to the slab during such expansions and contractions. Unfortunately, however, the geo-membranes tend to have such low surface friction that as the concrete shrinks, it encounters less resistance to sliding across the geo-membrane. Therefore, instead of cracking and separating at all pre sawed locations in the slab, the concrete separates at only a select few dominant control joints. With such low surface friction on the concrete slabs, there is not enough force to separate all of the joints. Instead, most of the control joints remain fused and slide along the geo-membrane with the rest of the concrete. This produces an unpleasant look with large gaps in a few locations of the slab and may promote other problems resulting from the change structural and mechanical properties of the slab as a whole.

SUMMARY

The present disclosure provides for an adherent layer to attach a geo-membrane to concrete slabs. In some embodiments, the adherent layer may have an adhesive on one side in order to attach the adherent layer to a geo-membrane and a textured surface on the other side, to attach the adherent layer to the concrete slab. In some embodiments, this will allow the adherent layer to keep the geo-membrane in close contact with the concrete slab. In some embodiments, this will prevent the geo-membrane from sagging below the concrete slab and thereby separating at the seams to allow water to penetrate the geo-membrane.

In an embodiment, the adherent layer will therefore provide protection from the penetration and pooling of water through and underneath the concrete slab. This will prevent structures such as residential houses and carpets from becoming moldy, damaged and infested with harmful microbes, bacteria, chemicals or other harmful particulates that may be contained in the water and ground below a concrete foundation. In an embodiment, attachment of the geo-membrane to the concrete foundation is also advantageous as once the geo-membrane has sagged and separated at the seams, it is extremely burdensome to fix the geo-membrane barrier as it is covered by the concrete slab.

In one embodiment, the adherent layer may have a textured layer comprised of an aperture film or other texture providing component attached to a substrate of the adherent layer with an adhesive or other means of attachment known in the art. In an embodiment, the adherent layer may be self wound with only a backing on the adhesive side of the adherent layer. In another embodiment, the adherent layer is installed underneath a concrete slab by first applying a geo-membrane to a soil, attaching an adherent layer to various parts of the geo-membrane, the adherent layer having a substrate, a first adhesive layer applied to a top of the substrate, a second adhesive layer applied to a bottom of the substrate and a textured layer applied to the top of the substrate and over the first adhesive layer, and next pouring the concrete on the geo-membrane and the adherent layer, and allowing the concrete to dry and form a bond with the adherent layer. In an embodiment, the geo-membrane may be a vapor barrier. In another embodiment, the first adhesive layer may be plastic or other suitable materials for heat bonding and the substrate may be heat bonded to the geo-membrane.

In another embodiment, the aperture film may be composed of two layers of fibers. In an embodiment, the fibers may be woven. In yet another embodiment, the textured layer may be composed of a second substrate and fibers connected to the second substrate. In an embodiment, the first substrate may be polyethylene. In an embodiment, the first adhesive layer and second adhesive layer may be a pressure sensitive. In an embodiment, the texture layer may be heat bonded to the first substrate. In another embodiment, the textured layer may be formed on the surface of the first substrate.

DETAILED DESCRIPTION OF THE PREFERRED EMBODIMENTS

Embodiments of the disclosure will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the disclosure. Furthermore, embodiments of the disclosure may include several novel features, no single one of which is solely responsible for its desirable attributes or which is essential to obtaining the adjectives herein described.

Embodiments of systems, devices, and methods are disclosed herein for providing an adherent layer for providing a bond between a geo-membrane and a concrete slab. More specifically, an adherent layer that can be attached to the geo-membrane is provided upon which the concrete is poured to form either or both an adhesive bond and a mechanical bond to the underside of the concrete once it has hardened. FIGS. 1-7 illustrate various exemplary embodiments and methods of the disclosure.

Figure 1:
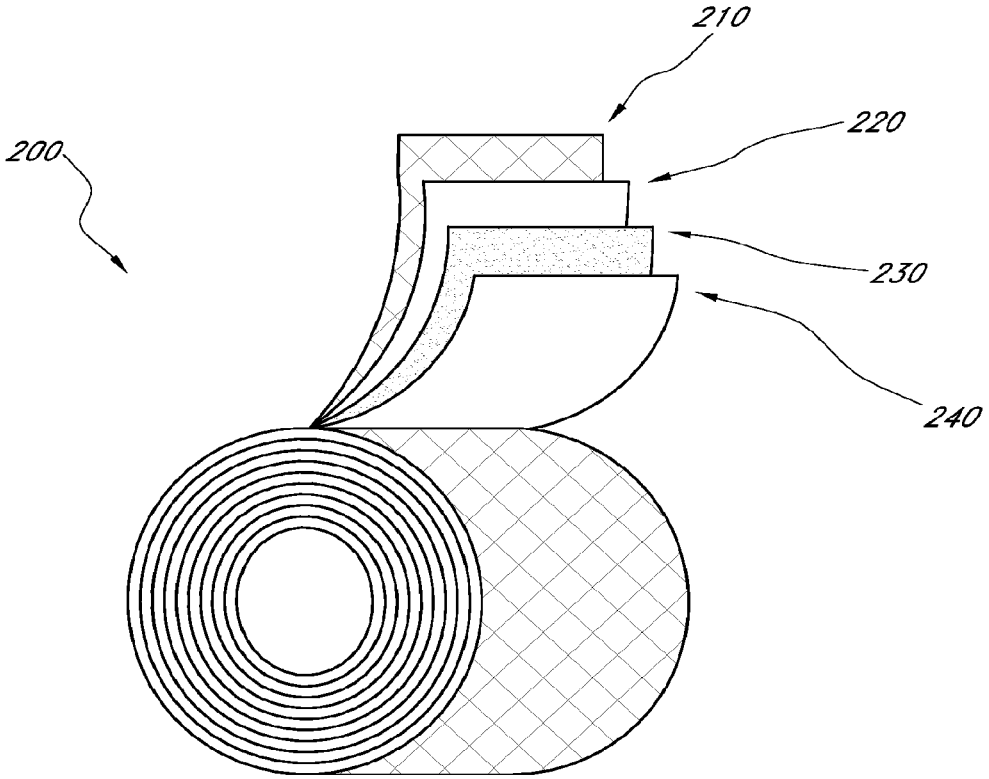
FIG. 1 illustrates an embodiment of the present disclosure.

FIG. 1 illustrates an embodiment of adherent layer 200 for attaching geo-membrane 100 to concrete slab 400. Adherent layer is a broad term and includes, without limitation, seaming tape, sealing strips, tape, squares of material, textured layers alone in any size or shape, multilayer strips, a layer of material with a textured layer and an adhesive on one side and an adhesive on the other side, and other layers of material with the potential to form a mechanical or adhesive bond with concrete and an adhesive bond with geo-membrane 100.

Geo-membrane is a broad term and includes, without limitation, vapor barriers, vapor retarders, vapor guards, moisture barriers, moisture guards, gas barriers and any other geo-membrane placed below a concrete slab to prevent migration of gases, water vapor, and other substances from migrating into a concrete slab from the ground below. For example, geo-membrane 100 may be a multi-layered polyolefin plastic extrusion manufactured vapor barrier. The thickness of geo-membrane 100 may vary and in one embodiment may be within any of the following ranges: 2-10 mils, 5-15 mils, 10-20 mils, 15-30 mils, 25-45 mils, 40-60 mils, 50-85 mils, and 65-100 mils. In one embodiment, the thickness of geo-membrane 100 may be any of the following thicknesses: 2 mils, 4 mils, 5 mils, 6 mils, 8 mils, 10 mils, 12 mils, 15 mils, 20 mils, 30 mils, 45 mils, 55 mils, 65 mils, 75 mils, 80 mils, 95 mils, and 100 mils. However, other thicknesses, extrusion methods, and materials known in the art may be used for geo-membrane 100.

In one embodiment, adherent layer 200 is composed of textured layer 210, first adhesive layer 220, substrate 230, and second adhesive layer 240. In some embodiments, each of these layers are laminated together to form a single sheet of material. In some embodiments, this single sheet of material may be cut into elongated strips which have length greater than their width to form a tape. In other embodiments, the layers may be combined together using other suitable methods known in the art including gluing, welding or other bonding techniques.

In one embodiment, the width of adherent layer 200 may be in any of the following ranges: 2-5 inches, 5-10 inches, 10-15 inches, 15-20 inches, 18-30 inches, 20-40 inches, and 50-100 inches. In another embodiment, adherent layer may be any of the following widths: 2 inches, 12 inches, 16 inches, 18 inches, 25 inches, 30 inches, 45 inches, 60 inches, and 100 inches.

In one embodiment, substrate 230 provides a surface for first adhesive layer 220, second adhesive layer 240, and textured layer 210 to be applied. Substrate 230 can be made of any material to which an adhesive can be applied to either side and textured layer 210 can be applied to at least one side. Substrate 230 may be made of a material that prevents moisture or other permeating substances from migrating through the material, including polyethylene, other plastics, paper, or other suitable materials known in the art.

In one embodiment of the present disclosure, first adhesive layer 220 is applied to one side of substrate 230 and second adhesive layer 240 is applied to a second side of substrate 230. First adhesive layer 220 is used and adapted to form a bond between concrete slab 300 and substrate 230. Second adhesive layer 240 is adapted to form a bond between geo-membrane 100 and substrate 230. In one embodiment, first adhesive layer 220 and second adhesive layer 240 are both a pressure sensitive adhesive adapted to form bonds between plastic, paper, concrete and other materials. In other embodiments, first adhesive layer 220 is a different adhesive than second adhesive layer 240, and each can be comprised of any number of the wide array of adhesives known in the adhesive, concrete, or electrical arts. For example, either or both of first adhesive layer 220 and second adhesive layer 240 may be comprised of any one of the following adhesives: a rubber-based adhesive, a pressure sensitive adhesive, an acrylic adhesive, a blend of natural rubber and synthetic rubber adhesive, or any other suitable adhesives. Such adhesives may be obtained from a variety of manufacturers including, for example, adhesive product numbers AF339 and RF440 from Syntac Coated Products LLC, at 29 Industrial Park Road, New Hartford, Conn. 06057.

Textured layer 210 is attached to the substrate 230 on the same side as first adhesive layer 220. Textured layer 210 can be attached to substrate 230 before or after the first adhesive layer 220 is applied. Textured layer is a broad term and includes, without limitation, aperture film, material with protruding fibers, woven materials, material with parallel and perpendicular grids of fibers, and can consist of any material that has holes or protrusions, fibers or other substantial surface topography useful in forming a mechanical bond with concrete. It is believed that the holes, protrusions, and fibers allow wet concrete to fill in and around the protrusions while the concrete is still wet and flowing. Eventually, the concrete will harden in and around these holes and protrusions thereby forming a mechanical bond with concrete slab 300.

Figures 2A, 2B:
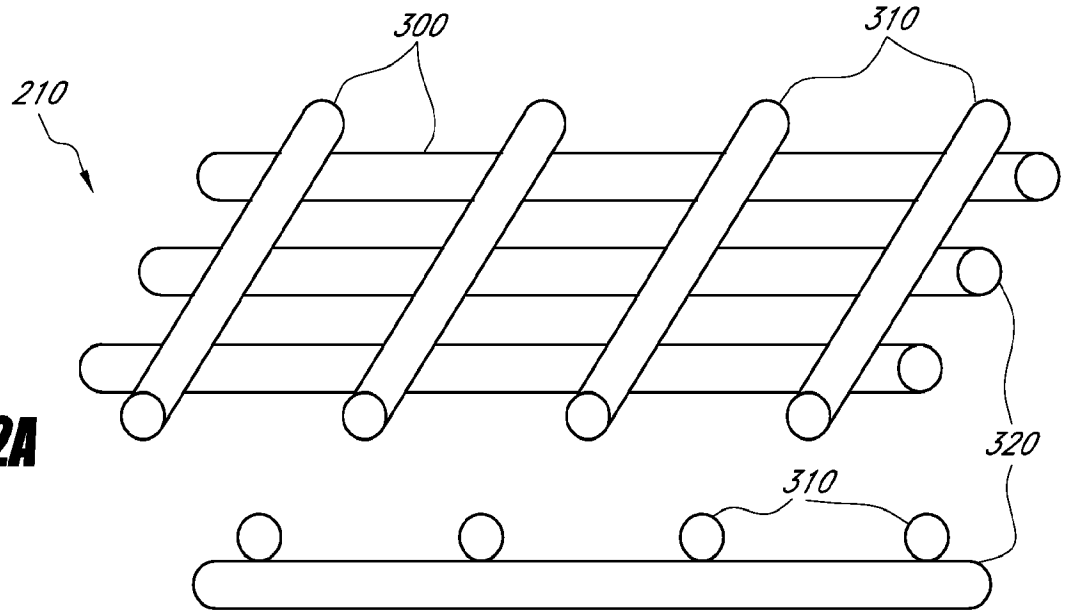
FIGS. 2A-2B illustrate an embodiment of the present disclosure.

An example of textured layer 210 is shown in FIGS. 2A-2B. FIG. 2A shows an embodiment of textured layer 210 that is composed of two layers of fibers 300. The fibers 300 that comprise first layer 310 are oriented relatively parallel to one another. Fibers 300 that comprise the second layer 320 are similarly oriented relatively parallel to one another and also relatively perpendicular to fibers 300 that comprise first layer 310. First layer 310 and second layer 320 are then attached by means known in the art including glue, plastic welding or other suitable means.

Fibers 300 may be made of any fabric, plastic, metal or other material that may easily be drawn into strands. Also, first layer 310 and second layers 320 may be woven together or oriented in any other suitable means to provide protrusions for wet concrete to harden around and form a mechanical bond with fibers 300. Textured layer 210 may also be constructed in any other orientation or from any other material with protrusions or surface topography that allows a mechanical bond to form between concrete and textured layer 210.

Relatively parallel fibers in first layer 310 and second layer 320 are spaced apart sufficient distance to allow concrete to seep through the spaces in-between fibers 300 while maintaining enough fibers to provide a strong mechanical bond between the adherent layer 200 and concrete slab 400 once the wet concrete has hardened around fibers 300. For example, the distance between relatively parallel fibers in the first layer 310 and second layer 320 fibers 300 may be spaced apart by around 30-40 mils, 35-50 mils 45-55 mils, 50-60 mils or any other suitable distance. The distance between the fibers in first layer 310 may be different than the distance between parallel fibers 300 in second layer 320. In one embodiment, the distance between parallel fibers may be any of the following distances: 30 mils, 45 mils, 50 mils, 55 mils, or 60 mils.

FIG. 2B illustrates a side view of textured layer 210. The thickness of textured layer 210 may vary, however, possible ranges of thicknesses from the bottom of fibers 300 of second layer 320 to the top of fibers 300 of first layer 320 as shown in FIG. 2B include 10-12 mils, 12-25 mils, and 25-30 mils. In one embodiment, the thickness of textured layer 210 as shown in FIG. 2B may be any of the following thicknesses: 10 mils, 12 mils, 15 mils, 18 mils, 20 mils 25 mils, or 30 mils.

In one embodiment, adherent layer 200 may be wound into a roll as shown in FIG. 1. Advantageously, in embodiments in which first adhesive layer 220 is used and textured layer 210 is placed on top, a backing covering first adhesive layer 220 is not necessary as textured layer 210 will protrude beyond first adhesive layer 220 and therefore prevent contact of first adhesive layer 220 with other blunt objects, including other layers of tape on the roll when wound as shown in FIG. 1. Therefore a backing layer may only be necessary to cover second adhesive layer 240. This decreases the cost and expense of manufacturing the tape as a backing layer is not required to cover first adhesive layer 220. Additionally, this makes handling the side of adherent layer 200 with first adhesive layer 220 very convenient as adherent layer 200 will not stick to fingers or other tape handling devices that are too blunt to protrude through the openings of textured layer 210 to contact adhesive layer 200.

In another embodiment, adherent layer 200 may consist primarily of textured layer 210, which can be applied directly to the geo-membrane 100 without first adhesive layer 220, second adhesive layer 240, or substrate 230. The adherent layer 200 may come pre-attached to the geo-membrane 100 or adherent layer 200 may be attached to the geo-membrane 100 during installation of the geo-membrane 100 prior to pouring concrete on top of geo-membrane.

In another embodiment, adherent layer 200 may be sold as a system or kit comprising various components. For example, textured layer 210 may be sold as a system in a kit with an adhesive and textured layer 210 separate from substrate 230. The kit may include substrate 230 with second adhesive layer 240 already applied but with textured layer 210 separate to be applied to substrate 230 as needed or before installation. Also, the system or kit may include the components of adherent layer 200 already assembled including, for example, substrate 230, second adhesive layer 240 and textured layer 210 already wound on a roll or cut into strips. The kit may include various other items including measuring tools, cutting tools or other components known in the art for installing adherent layer 200.

METHODS OF USE

Below are several methods of implementing the present disclosure. Although the step of the methods outlined for applying the adherent layer are described as being performed in a particular order, one skilled in the art will appreciate that these steps may be performed in a modified or different order, or in an embodiment utilizing less than all of the steps described below. Further, one or more of the steps provided for each method may be preformed concurrently or in parallel.

Figure 7:
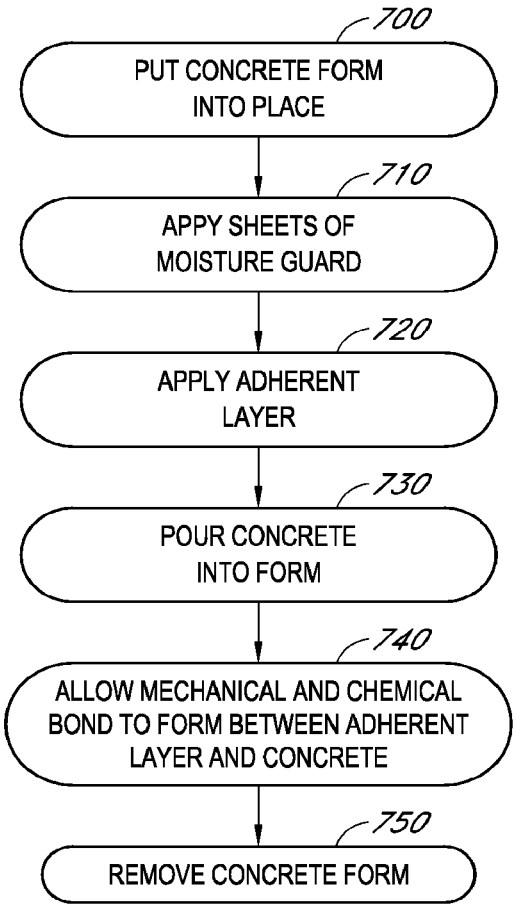
FIG. 7 illustrates a sequence of steps that may be performed in accordance with the present disclosure.

FIG. 7 illustrates the steps involved in one embodiment of the present disclosure. In method of the present disclosure, concrete forms 540 and 550 are employed into the desired area for pouring concrete slab 400 or other concrete foundation or support structure (Step 700). Next, one or many sheets of geo-membrane 100 are applied to soil 500 and optionally to forms 540 and 550 to cover all or most of the area where the concrete will be poured (Step 710). The geo-membrane 100 may or may not be applied to form 540 and therefore may or may not cover a surface of form 540.

Next, adherent layer 200 is applied to geo-membrane 100 (Step 720). In this step, adherent layer 200 may cover the majority of one side of geo-membrane 100 or it may be placed in pieces or strips on geo-membrane 100. In one embodiment, adherent layer 200 is applied to the outside rim of geo-membrane 100. In another embodiment, adherent layer 200 is placed as strips only on the overlap between sheets of geo-membrane 100 known as "seams."

Adherent layer 200 can be attached by any means known in the art. In one embodiment, adherent layer 200 includes second adhesive layer 240. Once adherent layer 200 is applied to geo-membrane 100, second adhesive layer 240 forms an adhesive bond with geo-membrane 200.

Thereafter, concrete can then be directly poured onto adherent layer 200 and geo-membrane 100, filing the space created by wood form 540 and stake 550 (Step 730). Once the concrete has been poured it can then be allowed to harden into concrete slab 400 or other foundation. In some embodiments, while the wet concrete is hardening, it will form a chemical or adhesive bond with adherent layer 200 (Step 740). This is particularly true for embodiments in which adherent layer 200 includes first adhesive layer 220 on top of substrate 230. Additionally, as the concrete hardens, it may form a mechanical bond with textured layer 210.

After concrete slab 400 has hardened and formed either or both a mechanical and chemical bond with adherent layer 200, a strong bond will be formed between concrete slab 400, adherent layer 200, and geo-membrane 100. This will keep geo-membrane 100 fixed and closely engaged with concrete slab 400 while adherent layer 200 is in-between and bonded to both the concrete slab 400 and geo-membrane 100.

With geo-membrane 100 fixed to the concrete slab 400, a plethora of problems arising from moisture, including water vapor migration, can be avoided as explained below with reference to various examples of methods or applications of the present disclosure. These methods are not intended to be limiting and only serve as an example of the possible applications or processes of the present disclosure.

Figure 3:
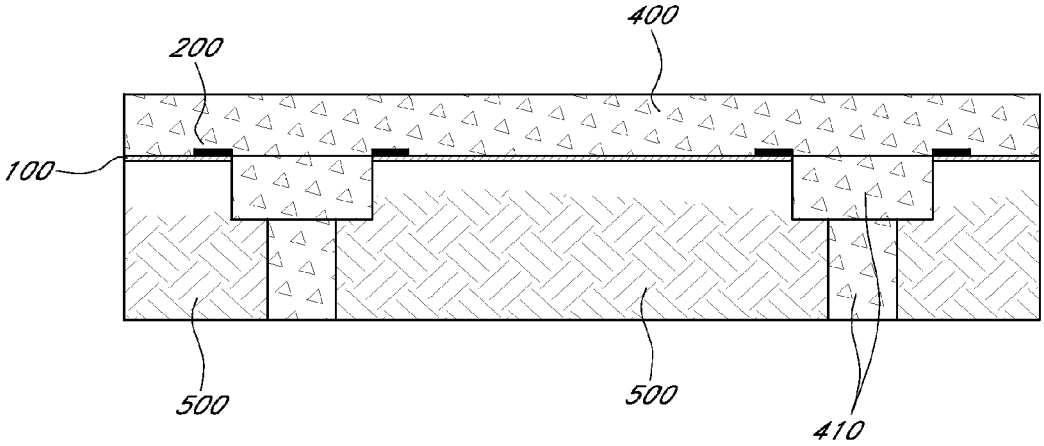
FIG. 3 illustrates a method of the present disclosure.

FIG. 3 illustrates a method of the present disclosure showing its application to the underside of concrete slab 400 that is supported by concrete piers 410. Concrete piers 410 are formed in soil 500. Initially, the level of soil 500 is nearly flush with the top of concrete piers 410. This allows one to lay down the geo-membrane 100 on top of the soil and concrete piers 410. After which, adherent layer 200 is applied to the desired places of the geo-membrane 100.

Next, and as described above in reference to FIG. 7, the concrete may be poured over geo-membrane 100 and adherent layer 200. After the concrete hardens adherent layer 200 will have bonded with geo-membrane 100 and to the underside of the concrete slab 400. If soil 500 settles, the level of soil 500 with then sink below its initial level as shown in FIG. 3. This leaves empty space between soil 500 and the underside of concrete slab 400 as shown in FIG. 3.

Because adherent layer 200 affixes the geo-membrane 100 to the concrete slab 400, the adherent layer prevents geo-membrane 100 from drooping below concrete slab 400 or becoming completely disengaged from concrete slab 400 when soil 500 settles. If geo-membrane 100 does not remain in contact with concrete slab 400, moisture, or other permeating substances would be permitted to travel through the seams or perimeters of geo-membrane 100, comprising the function of the geo-membrane 100. Instead, if adherent layer 200 is placed on either seams, perimeters, or other areas of geo-membrane 100, it will prevent the geo-membrane 100 from sagging in those areas and will prevent moisture, and other permeating substances from migrating between the seams and perimeter of geo-membrane 100 in the areas where adherent layer 200 is placed.

Figure 4:
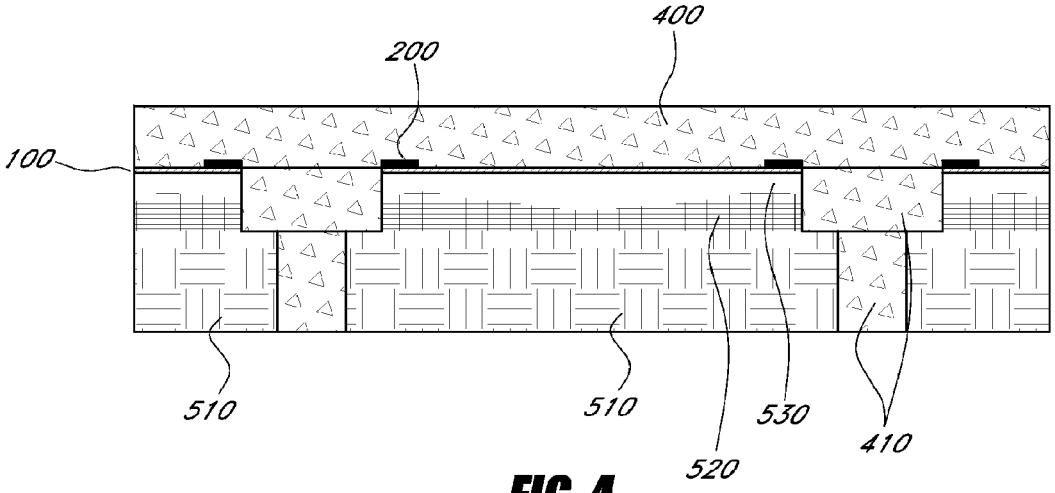
FIG. 4 illustrates a method of the present disclosure.

FIG. 4 illustrates another method of the present disclosure where adherent layer 200 fixes geo-membrane 100 to the underside of concrete slab 400. In this embodiment, concrete piers 410 are formed in expansive soil 500. In this embodiment, because soil 500 is expansive, the soil is not filled to nearly flush to the top of concrete piers 410 as in FIG. 3. Instead, space remains between the top of soil 500 and the top of concrete piers 410. In this space, void forms 520, are placed to fill in the gap between the top of soil 500 and the top of concrete piers 410 so that the top of void forms 520 are flush with the top of concrete piers 410.

Void forms 520 are typically constructed from corrugated paper or other materials known in the art. Void forms 520 initially create a platform onto which the concrete can be poured. Eventually, void forms 520 absorb moisture from the ground and weaken, creating a space for soil 500 to expand. Otherwise, expansive soil 500 would cause damage to the concrete slab through excess upward pressure from underneath the concrete slab 400.

Geo-membrane 100 can then be overlaid on top of void forms 520 and concrete piers 410 with adherent layer 200 being placed in desired locations. Concrete is then poured on top of geo-membrane 100 and adherent layer 200, which is allowed to dry forming a bond with adherent layer 200 and thereby attaching concrete slab 400 to geo-membrane 100. This will keep geo-membrane 100 closely engaged with the underside of concrete slab 400.

After void forms 520 absorb moisture from soil 500, they become weak and deteriorate thus creating space between the soil 500 and the underside of concrete slab 400. Without application of adherent layer 200 to geo-membrane 100 this space would allow sagging of the geo-membrane 100. This sagging would take place both if soil 500 does not fully expand to fill the space left by the deteriorated void form 520 and during the time before the soil 500 completes its expansion to fill the space.

However, in this method, adherent layer 200 is applied to geo-membrane 100 and also bonds with concrete slab 400 as described above and therefore reduces the sagging of geo-membrane 100 from below concrete slab 400. Reduced sagging reduces the opportunity for leaks to develop around the seams and perimeter of the geo-membrane 100 that would otherwise allow for moisture or other permeating substances from migrating through the seams or perimeters.

Figure 5A:
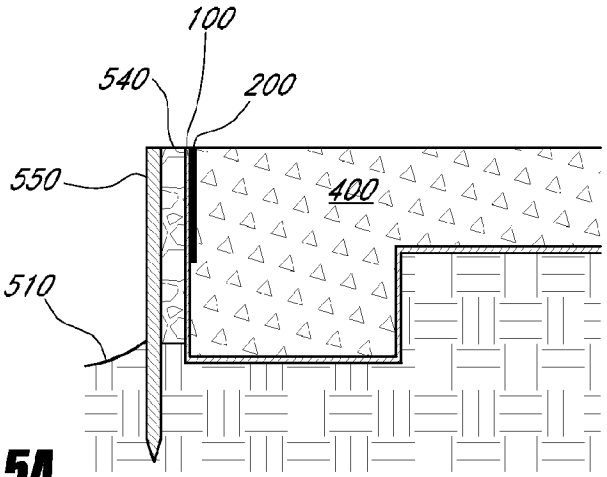
FIGS. 5A-5D illustrate a method of the present disclosure.

FIGS. 5A-5D illustrate another method of the present disclosure where adherent layer 200 may be used to affix geo-membrane 100 to the vertical face of the perimeter of concrete slab 400. FIG. 5A illustrates a method of installing the form for pouring the concrete. Stake 550 and wood form 540 or any other device known in the art for creating a form for pouring a concrete slab 400 are installed into soil 500. Next, geo-membrane 100 is laid down on soil 500 and along the side of wood form 540 and terminating at or near the top of wood form 540.

Adherent layer 200 is then installed on various places of geo-membrane 100 as described in reference to FIG. 7. As illustrated in FIGS. 5A-5D, in this method, adherent layer 200 is, among other places, installed along or near the upper perimeter of geo-membrane 100 where geo-membrane 100 terminates near the top of wood form 540. As the concrete is poured into the form and concrete slab 400 forms, the concrete will form a bond with adherent layer 200 as described in reference to FIG. 7 near the top of a sidewall of concrete slab 400.

Figure 5B:
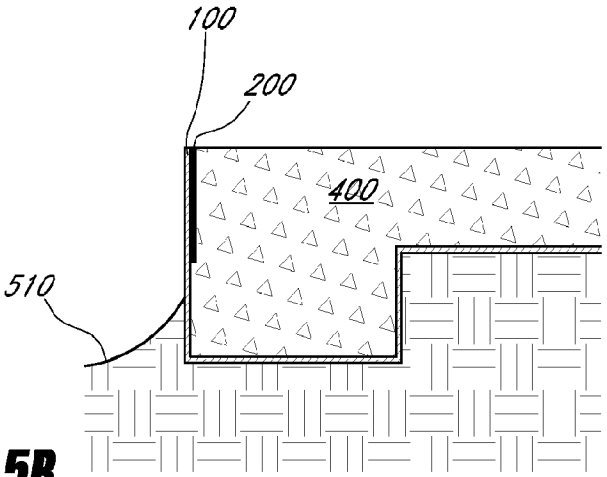
Figure 5C:
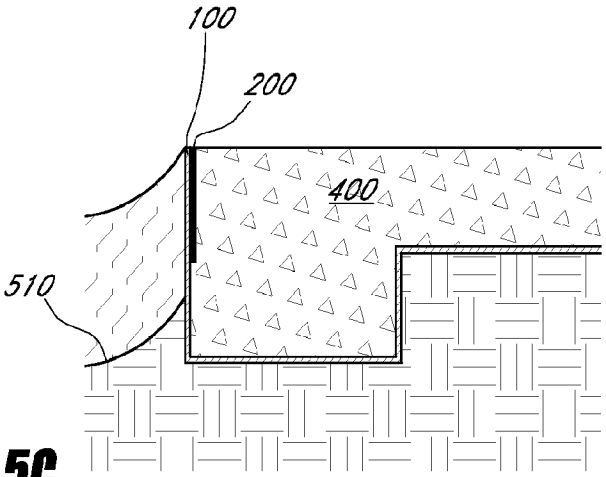

As illustrated in FIG. 5B, when stake 550 and wood form 540 are removed from engagement with geo-membrane 100 and concrete slab 400, geo-membrane 100 will remain in place and closely engaged with concrete slab 400. This will prevent fishmouths or openings from developing between the geo-membrane 100 and concrete slab 400 before, during, and after filler soil 560 is installed next to concrete slab 400 as illustrated in FIG. 5C. This will reduce the amount of moisture or other permeating substances that will leak down the side of geo-membrane 100, between the geo-membrane 100 and concrete slab 400 to underneath and through concrete slab 400.

Figure 5D:
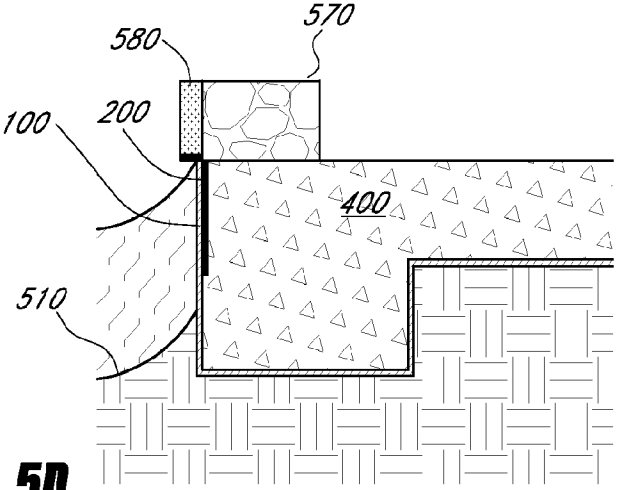

As illustrated in FIG. 5D, frame 570 and façade 580 may be built on top of concrete slab 400. Façade 580 may have weep holes or other drainage system causing moisture, rain or other water or permeating substances that permeate façade 580 to drain out of the bottom of façade 580. In this method, adherent layer 200 will keep geo-membrane 100 closely engaged to concrete slab 400 and prevent the drainage water or other permeating substances from seeping between geo-membrane 100 and concrete slab 400, which would otherwise cause moisture and other water vapor related damage as discussed above.

Figure 6A:
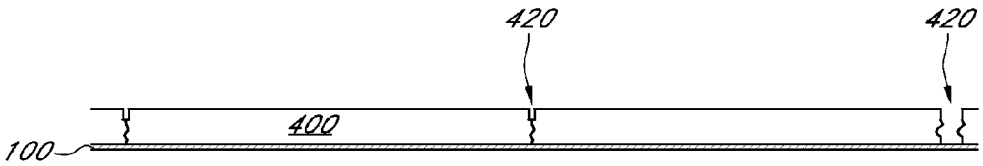
FIGS. 6A-6B illustrate a method of the present disclosure.
Figure 6B:
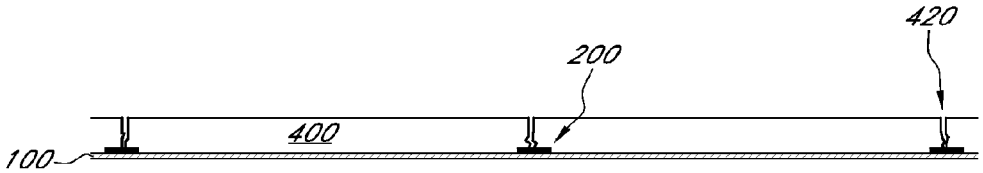

FIGS. 6A-6B illustrate another method where adherent layer 200 is placed on geo-membrane 100 at various locations including underneath and around control joints 420 that are pre-sawed into concrete slab 400 in order to create spaces where concrete can separate and contract without cracking. Typically, concrete slabs 400 placed directly onto geo-membrane 100 without adherent layer 200 have a tendency to slip across geo-membrane 100 as the concrete contracts during drying and setting. This causes the concrete to crack and separate only at dominant control joints 420 as illustrated in FIG. 6A instead of uniformly across all control joints 420 as will be explained further below.

In this method, with adherent layer 200 placed in various locations on geo-membrane 100, including beneath control joints 420, in accordance with the methods described with respect to FIG. 7, adherent layer 200 increases the friction between concrete slab 400 and geo-membrane 100 by using adhesive and mechanical interactions between concrete slab 400, adherent layer 200, and geo-membrane 100. This prevents the concrete slab 400 from contracting to create only one dominant control joint 420 and causes controlled cracking at most control joints 420.

Otherwise, without adherent layer 200, the majority of control joints 420 would not crack and instead remain fused as the sliding friction between geo-membrane 100 and concrete slab 400 would not be great enough to crack the concrete at all control joints 420. Instead, the majority of control joints 420 would slide along geo-membrane 100 remaining fused with concrete on both sides of the control joint 420 moving in the same direction. With the addition of adherent layer 200 to geo-membrane 100, the static frictional force opposing the sliding of concrete slab 400 across geo-membrane 100 and adherent layer 200 would be great enough to crack most control joints 420 instead of control joints 420 remaining strong enough to drag a large portion of the concrete slab 400 across geo-membrane 100. This method ultimately promotes the development of more evenly sized membrane 100. This method ultimately promotes the development of more evenly sized spaces in a set of control joints 420 in concrete slab 400 as illustrated in FIG. 6B.

Figure 8:
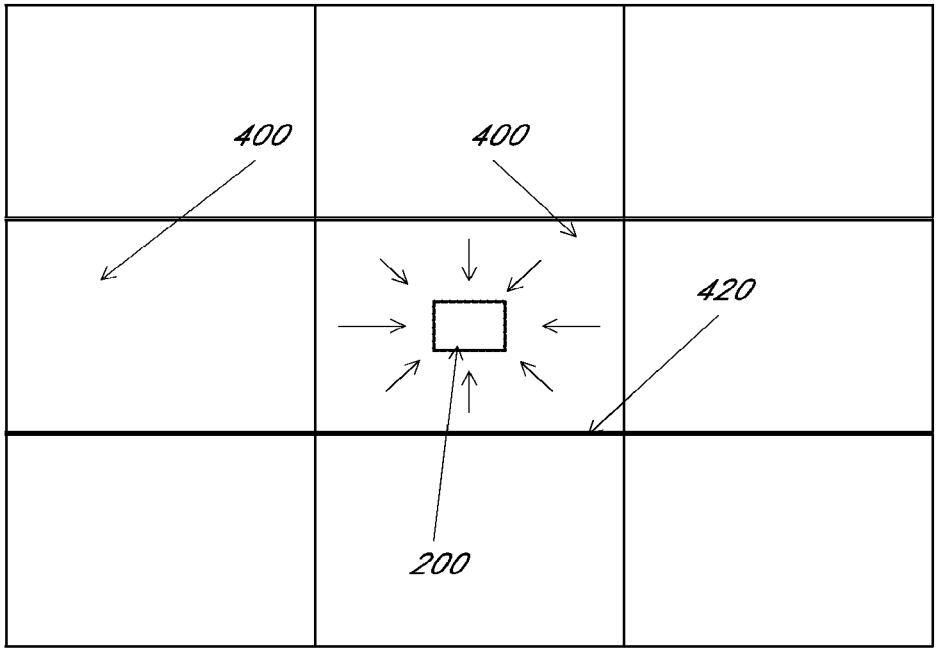
FIG. 8 illustrates a top view of a method of the present disclosure.

FIG. 8 illustrates an embodiment of the method illustrated in FIGS. 6A-6B. FIG. 8 illustrates a view from above a concrete slab 400 that has been pre-sawed at control joints 420. In this embodiment, the control joints 420 form individual sections of the concrete slab 400 that will shrink during drying of the concrete. However, as the concrete slab 400 rests on top of geo-membrane 100 the low friction between the concrete slab 400 and geo-membrane would ordinarily allow the concrete slab 400 sections to shrink in different directions, leaving differently size spaced at the control joint 420 locations, or causing only some the control joints 420 to break.

In an embodiment, in order to control the direction the concrete slab 400 will shrink, a patch of adherent layer 200 may be attached to geo-membrane 100 in strategic places to provide an anchor point to which the concrete slab 400 sections will shrink towards. In one embodiment, the adherent layer may be placed at strategically spaced apart locations on top of geo-membrane 100 around which control joints 420 may be sawed after the concrete slab 400 has been poured. Next, control joints 420 may be sawed to create square sections of concrete slab 400 in such a way that the patches of adherent layer 200 would be in the center of the square sections.

In this embodiment, the adherent layer 200 patches will provide an anchor point in each concrete slab 400 square that will cause the outer sections of the concrete slab 400 square to shrink towards. This will provide the necessary forces on the sections to advantageously cause all or a greater number of control joints 420 to break apart and promote an even spacing between the concrete slab 400 sections. This will provide a more pleasing look and increased structural stability during the changing temperatures of the seasons, and reduce cracking of the concrete.

Although the foregoing has been described in terms of certain specific embodiments, other embodiments will be apparent to those of ordinary skill in the art from the disclosure herein. Moreover, the described embodiments have been presented by way of example only, and are not intended to limit the scope of the disclosure. Indeed, the novel methods and systems described herein may be embodied in a variety of other forms without departing from the spirit thereof. Accordingly, other combinations, omissions, substitutions, and modifications will be apparent to the skilled artisan in view of the disclosure herein.

What is claimed is:

1. An adherent layer for sealing a seam between a first geo-membrane sheet and a second geo-membrane sheet and for forming a bond to concrete poured atop the adherent layer, the adherent layer comprising:

a substrate;

a first adhesive layer applied to a top of the substrate;

a second adhesive layer applied to a bottom of the substrate; and a textured layer applied to the top of the substrate and over the first adhesive layer, the textured layer forming the bond with the concrete poured atop the adherent layer, wherein the textured layer includes:

a first set of fibers oriented adjacent respectively to each other, and a second set of fibers oriented adjacent respectively to each other, oriented transverse with respect to the first set of fibers, and further oriented so as to form protrusions from a surface of the textured layer, wherein respective adjacent fibers of the first set of fibers are spaced apart in a range of about 30 mils to about 60 mils to provide space in which concrete enters between the first and second sets of fibers when poured thereon, and wherein a thickness of the textured layer ranges from about 10 mils to about 30 mils.

2. The adherent layer of claim 1 wherein the textured layer is an aperture film.

3. The adherent layer of claim 1 wherein the substrate is polyethylene.

4. The adherent layer of claim 1 wherein the first adhesive layer and second adhesive layer both include a pressure sensitive adhesive.

5. An adherent layer for attaching a first geo-membrane sheet to concrete or to a second geo-membrane sheet, the adherent layer comprising:

a substrate for supporting components of the adherent layer;

an adhesive layer applied to a first side of the substrate; and a textured layer applied to a second side of the substrate for forming a mechanical bond with concrete poured atop the adherent layer, wherein the textured layer includes:

a first set of fibers oriented adjacent respectively to each other, and a second set of fibers oriented adjacent respectively to each other, oriented transverse with respect to the first set of fibers, and further oriented so as to form protrusions from a surface of the textured layer, wherein respective adjacent fibers of the first set of fibers are spaced apart in a range of about 30 mils to about 60 mils to provide space in which concrete enters between the first and second sets of fibers when poured thereon, and wherein a thickness of the textured layer ranges from about 10 mils to about 30 mils.

6. The adherent layer of claim 5 wherein the adhesive layer includes a rubber-based, pressure sensitive adhesive.

7. The adherent layer of claim 5 wherein the textured layer is an aperture film.

8. The adherent layer of claim 5 wherein the textured layer is heat bonded to the substrate.

9. The adherent layer of claim 5 wherein the textured layer is a texture formed on the second side of the substrate.

10. The adherent layer of claim 5 wherein the first side of the substrate is configured to attach to the first geo-membrane sheet using the adhesive layer.

11. The adherent layer of claim 5 wherein the first side of the substrate is configured to attach to the first geo-membrane sheet and the second geo-membrane sheet using the adhesive layer.

12. The adherent layer of claim 11 wherein the adhesive layer is configured to seal a seam between the first geo-membrane sheet and the second geo-membrane sheet.

13. The adherent layer of claim 5 wherein the adherent layer is for attaching the first geo-membrane sheet to the concrete, the concrete being oriented vertically.

14. An adherent layer comprising:

a substrate;

a first adhesive layer applied to a top of the substrate;

a second adhesive layer applied to a bottom of the substrate; and a textured layer applied to the top of the substrate and over the first adhesive layer, the textured layer configured to form a mechanical bond with concrete poured atop the adherent layer, wherein the textured layer includes:

a first set of fibers oriented adjacent respectively to each other, and a second set of fibers oriented adjacent respectively to each other, oriented transverse with respect to the first set of fibers, and further oriented so as to form protrusions from a surface of the textured layer, wherein respective adjacent fibers of the first set of fibers are spaced apart in a range of about 30 mils to about 60 mils to provide space in which concrete enters between the first and second sets of fibers when poured thereon, and wherein a thickness of the textured layer ranges from about 10 mils to about 30 mils.

15. The adherent layer of claim 14 wherein the textured layer is an aperture film.

16. The adherent layer of claim 14 wherein the first adhesive layer and second adhesive layer both include a pressure sensitive adhesive.

17. The adherent layer of claim 1 wherein the thickness of the textured layer ranges from about 12 mils to about 25 mils.

18. The adherent layer of claim 1 wherein respective adjacent fibers of the second set of fibers are spaced apart in a range of about 30 mils to about 60 mils to provide space in which concrete enters between the first and second sets of fibers when poured thereon.

19. The adherent layer of claim 1 wherein the respective adjacent fibers of the first set of fibers are spaced apart in a range of about 35 mils to about 50 mils.

20. The adherent layer of claim 1, wherein the respective adjacent fibers of the first and second sets of fibers are disposed in parallel to each other.

* * * * *